US006711749B2

(12) United States Patent
White et al.

(10) Patent No.: US 6,711,749 B2
(45) Date of Patent: Mar. 30, 2004

(54) ARTICLE OF HEADWEAR WITH INTEGRATED HAIRBAND

(76) Inventors: Peggy Lee White, 221 Upper County Rd., # 201, Dennisport, MA (US) 02639; John Joseph Sheehan, 221 Upper County Rd., # 201, Dennisport, MA (US) 02639

( * ) Notice: Subject to any disclaimer, the term of this patent is extended or adjusted under 35 U.S.C. 154(b) by 85 days.

(21) Appl. No.: 10/052,501

(22) Filed: Jan. 23, 2002

(65) Prior Publication Data

US 2003/0135912 A1 Jul. 24, 2003

(51) Int. Cl.[7] ..... A42B 3/22
(52) U.S. Cl. ..... 2/195.8
(58) Field of Search ..... 2/195.8, 200.1, 2/175.1, 171.8, 671.4, 174

(56) References Cited

U.S. PATENT DOCUMENTS

| | | | | | |
|---|---|---|---|---|---|
| 4,074,365 | A | | 2/1978 | Schuesler | |
| 4,937,885 | A | | 7/1990 | Gregg | |
| 5,170,509 | A | | 12/1992 | Leopold | |
| 5,239,705 | A | | 8/1993 | Leopold | |
| 5,303,427 | A | * | 4/1994 | Fishbaine | 2/209.11 |
| 5,321,854 | A | * | 6/1994 | Kronenberger | 2/209.7 |
| D353,226 | S | | 12/1994 | Nahoum | |
| 5,511,249 | A | | 4/1996 | Higgins | |
| 5,644,799 | A | | 7/1997 | Armenta | |
| D390,687 | S | * | 2/1998 | Kazel | D2/876 |
| D399,639 | S | * | 10/1998 | Bartz | D2/876 |
| D405,590 | S | * | 2/1999 | Bartz | D2/883 |
| D406,189 | S | * | 3/1999 | Hosogai | D2/882 |
| 5,875,494 | A | | 3/1999 | Garnier, Jr. et al. | |
| 5,899,211 | A | | 5/1999 | Brown | |
| 6,401,255 | B1 | * | 6/2002 | Douglas | 2/207 |

* cited by examiner

*Primary Examiner*—Katherine Moran
(74) *Attorney, Agent, or Firm*—Breneman & Georges

(57) ABSTRACT

An article of headwear having an integrated hairband and method for their construction is provided for cooperating with the headband for maintaining the headwear in a substantially fixed position on the wearer's head irrespective of the exercise or amount of activity of the wearer. In applications where the fixed position of the novel headwear dominates such as ski hats and exercise wear a substantially coplanar relationship is maintained to use the hair to anchor the headwear on the head. In applications where fashion vegarieties dictate an angular relationship can be provided between the headband and headwear in novel knitted articles of the invention. The invention integrates the hairband into the novel articles of headwear utilizing a plurality of loops to incorporate the hairband into the novel articles of headwear.

19 Claims, 5 Drawing Sheets

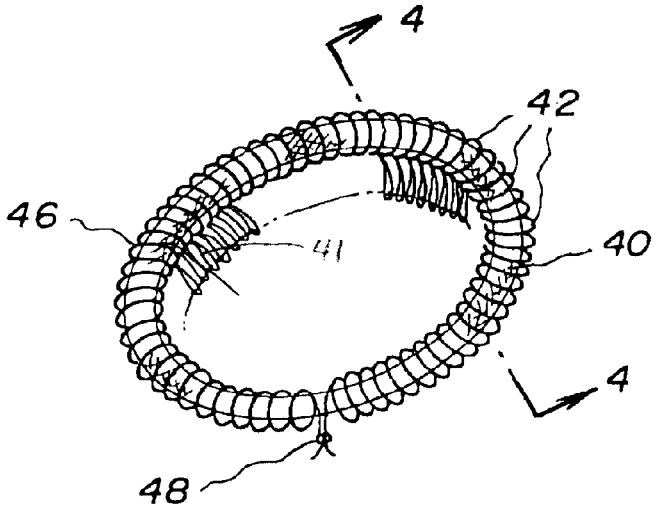
FIG. 3
FIG. 4
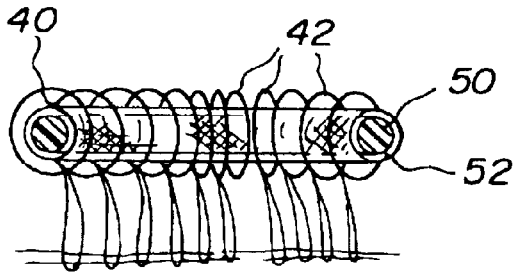
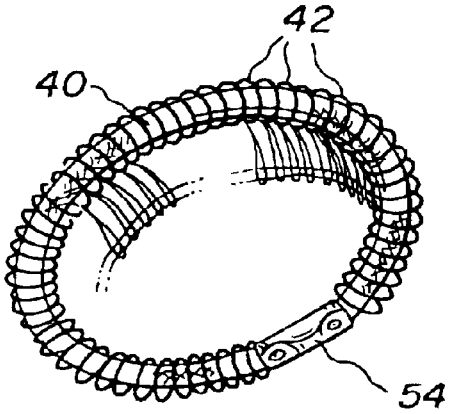
FIG. 5

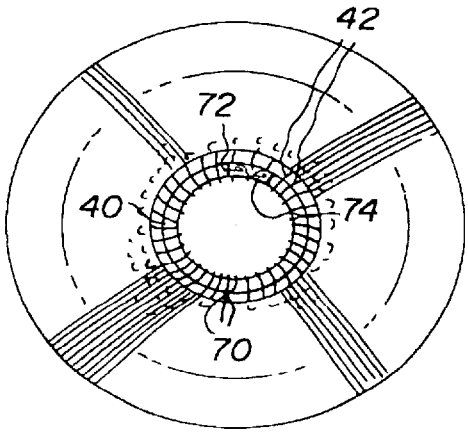
FIG. 9
FIG. 10
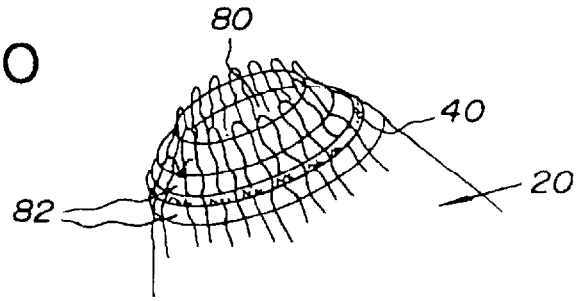
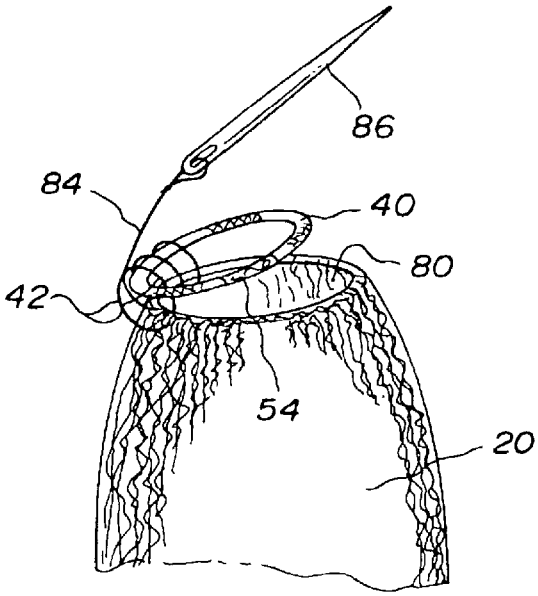
FIG. 11

ARTICLE OF HEADWEAR WITH INTEGRATED HAIRBAND

BACKGROUND OF THE INVENTION

1. Field of the Invention

The invention pertains to a knitted article of headwear with an integrated hairband for maintaining and holding a portion of the wearer's hair outside of the knitted article of headwear while securing the article of headwear to the wearer's head. More particularly, the invention pertains to a knitted hat or the like having the fabric covered hairband integrated into the knit at the distal end or intermediate the distal and proximal end of the knitted headwear. Knitted articles constructed in accordance with the invention are of a generally conical shaped knitted configuration of a ribbed, ribless, seam or seamless configuration.

The invention includes methods for producing novel knitted articles of headwear with integrated hairbands by utilizing flat knitting machines which knit a flat garment in which the ends are subsequently joined in the knitting process to form an article of headwear and methods for integrating the hairband in a knitted seam or use of Bulkie Knitting Machines or other such circular knitting machines for knitting circular garments without a seam in which the hairband is integrated into the knitted article of headwear.

2. Description of the Related Art Including Information Disclosed Under 37 CFR 1.97 and 1.98

The prior art includes a great variety and number of hats and headwear having apertures for accommodating a pony tail or hair of the wearer. Most of the prior art having apertures for accommodating hair or ponytails are made of woven fabric as opposed to knitted articles. Examples of hats or headgear having apertures for accommodating hair or ponytails include Garnier, Jr. et al., U.S. Pat. No. 5,875,494, Leopold U.S. Pat. Nos. 5,170,509 and 5,239,705, Armenta, et al. U.S. Pat. No. 5,644,799 and Higgins U.S. Pat. No. 5,511,249.

These articles of woven, as opposed to knitted headwear, utilize panels in which one or more of the panels or seams connecting the panels have openings in which a ponytail or hair may be threaded. For example, Garnier, Jr., et al. U.S. Pat. No. 5,875,494 includes overlapping panels that may be opened and closed to accommodate hair or ponytails while Armenta, et al. U.S. Pat. No. 5,644,799 includes headgear accessories that are installed by stitching or embroidering into an existing cap, hat or hood or other such article of headwear.

These prior art fabric hats, including Higgins U.S. Pat. No. 5,511,249, which includes an aperture at the terminal end of the hat do not include an elasticized hairband or an elastic fabric covered hairband that is knitted or integrated into the woven hat. Woven fabric hats have warp and weft threads that criss cross as opposed to a knitted or crocheted articles which have a plurality of inter connected loops. The invention utilizes the plurality of inter connected loops to integrate a hairband into the knitted article of headwear.

Further the prior art does not have a hairband or an elastic or elasticized fabric covered hairband covered with loops from the knitted article to integrate the hairband into the knitted article of headwear. The prior art also does not integrate the hairband into the distal end of the article of headwear so as to cooperate with the headband of the article of headwear to provide a restrictive closure to function as an integrated hairband which is part of the headwear to cooperate with the headband to maintain the article of headwear anchored firmly in place in accordance to the invention.

The prior art also includes other woven hats of the baseball type that include constricted apertures for gathering and holding the ponytail or wearer's hair through the headwear. Representative of such prior art includes Leopold U.S. Pat. Nos. 5,170,509 and Leopold 5,239,705. Such prior art pertaining to constricting apertures utilizing an elasticized opening are not integrated into the woven article with a plurality of loops around the hairband. The prior art hairbands are not the same type of fabric covered hairband and are attached by sewing the hairband into an aperture of the hat. In contrast the invention pertains to a knitted article of headwear constructed of a plurality of loops in which a fabric covered hairband is integrated into the knitted article utilizing the plurality of loops to become part of the knitted article.

Other prior art include woven hairbands such as shown in Nahoum U.S. Pat. Des. No. 353,226 in which a woven constrictive type hairband is illustrated. The woven hairband of Nahoum U.S. Pat. Des. No. 353,226 is not integrated into a knit of a knitted ski hat or article of headwear.

Brown U.S. Pat. No. 5,899,211 illustrates an elastic loop hairband of the type utilized for ponytails of the type utilized in the novel article of headwear of the invention. The elastic loop covered with fabric of Brown U.S. Pat. No. 5,899,211 is used to attach a hair extension and is not integrated into a knitted article of headwear and does not provide the advantages of the invention.

Other prior art such as Gregg U.S. Pat. No. 4,937,885 and Schuessler, et al. U.S. Pat. No. 4,074,365 pertain to a headgear article having a drawstring disposed at the distal end of the headgear. Gregg U.S. Pat. No. 4,937,885 does not utilize a hairband integrated into the plurality of loops of a knitted article but instead includes a drawstring that is threaded through a fold in a knit or weave to provide a closure for the head covering. Schuessler, et al. U.S. Pat. No. 4,074,365, like the present invention, pertains to a knitted article but does not utilize a hairband or integrate the hairband as part of the knitted article. Schuessler, et al. U.S. Pat. No. 4,074,365 instead pertains to a firmly attached tassel which is attached by a drawstring which is woven through the knitted strands of yarn to form a tassel. The drawstring does not form a constrictive aperture for the hair or ponytail of the wearer and as such is merely indicative of the general state of the art.

Milani U.S. Pat. No. 5,875,488 similarly pertains to an article of headgear having an elasticized aperture for receiving and providing a constrictive closure for a ponytail or the wearer's hair. Milani U.S. Pat. No. 5,875,488, like Leopold U.S. Pat. Nos. 5,170,509 and 5,239,705 is not integrated into a knitted article and like Leopold is disposed in the headband portion of the hat. Milani U.S. Pat. No. 5,875,488, like Leopold U.S. Pat. Nos. 5,170,509 and 5,239,705 do not mechanically anchor the hat to the head since the constrictive opening is co-located in the headband portion of the hat rather than displaced from the headband in a coplanar or angular location to cooperate with the headband to anchor the article of headwear to the head. Further Leopold U.S. Pat. Nos. 5,170,509, 5,239,705 and Milani U.S. Pat. No. 5,875,488 pertain to woven fabric hats as opposed to knitted headgear and as such do not integrate the elasticized hairband into a plurality of loops to integrate the hairband into a portion of the knit of the knitted article.

The invention unlike the prior art pertains to a knitted article having a hairband integrated into the knit of the knitted article of headwear. The novel headwear of the invention is of a substantially conical shape having a headband portion which forms the widest portion of the headwear and tapers to a distal end of the headwear in which the hairband is integrated into the knitted article itself. The distal portion of the knitted article remote from the proximal headband area of the headwear serves to not only accommodate the hair of the wearer but also to maintain and firmly anchor the position of the article of headwear on the head and around the ears of the wearer.

As will be recognized by those wearing ski hats and having long hair the greater the volume of hair under the ski hat the more likely the hair will cause the ski hat to ride up away from and over the ears of the wearer causing the wearer to pull the headband down and ski hat over the hair to crush the volume of hair under the ski hat. The pulling of the headband and ski hat over the head exacerbates two related problems. The first problem is the headband becomes stretched and allows the ski hat to ride up more quickly as the skier negotiates the ski slopes. The second related problem is that it crushes the hair and makes the hair more difficult to manage after skiing.

Both of these problems inherent in prior art ski hats are solved by the novel knitted article of headwear of the invention which integrates a hairband into the knitted article of headwear of the invention. The novel knitted headwear of the invention utilizes a standard ponytail or elasticized fabric covered elastic band that is integrated into the plurality of loops of the novel knitted articles of the invention that serves to not only hold the hair in place outside of the ski cap but also at the same time maintains the distal end of the headwear at a substantially fixed position with respect to the hair and scalp of the wearer.

Maintenance of the ski hat or knitted headwear articles in their intended position operates to ameliorate the problem of the wearer pulling the cap down over the ears and thus repeatedly stretching the headband portion and destroying the elasticity of the headband. The maintenance of the hair in the hairband in relation to the headband in relation to the head and scalp allows complete freedom of movement without jeopardizing the position of the novel knitted articles of the invention. This is particularly advantageous for the ski hats and active headwear since the anchoring of the hat on the head eliminates the constant readjustment of the position of the ski cap with respect to the head of the wearer and the stretching of the headband portion of the ski hat.

SUMMARY OF THE INVENTION

The invention provides a knitted article of headwear of the type generally used for skiing or jogging or as well as for fashion which includes an integrated hairband for fastening a portion of the wearer's hair or ponytail outside of the knitted article. The hairband is integrated into the knitted article of headwear and cooperates with the headband of the article of headwear by maintaining the knitted article of headwear in a stable position on the head of the wearer.

The novel knitted article of headwear and more particularly a skier's type hat is knitted in a tapered or somewhat conical configuration having at the proximal end a headband portion providing a standard stretch knit fit for engaging the wearer's head, ears and back of the neck. The proximal end tapers toward the distal end which at or near the distal end includes an integrated hairband which is integrated into the knit of the knitted article. The hairband provides a constricted aperture for the novel headwear and allows the hair or ponytail of the wearer to be drawn through the hairband which is integrated into the headwear so as to maintain the headwear in a desired position with respect to the hair and scalp of the wearer.

The novel article of headwear with the integrated hairband may include a standard hairband which is drawn through the looped knitted distal end of the article of headwear and then joined by tying, clamping or otherwise fixing of the ends of the hairband at or near the distal end of the knitted article. Alternatively, the hairband may be integrated into the loops of the knitted article by threading the hairband through the ends of the knit at or near the distal end of the tapered knitted article to provide a constricted aperture for engaging the hair of the wearer in the novel skier's hat.

The novel article of headwear may also include one or more seams running from the proximal end of the headwear to the distal end of the headwear which may include at least one hairband integrated into the loops of the knit in the seam that joins the knitted article to form the article of headwear of the invention.

Novel headwear of the invention may be constructed by utilizing a standard hairband used for ponytails which is cut or threaded through loops in the novel knitted headwear in the invention. The hairband may also be integrated into the novel knitted article by knitting the hairband into the knitted article at the proximal end of the knitted article or in a seam joining together the knitted article to form an article of headwear. The hairband may be a standard hairband purchased from a variety of sources or from a long strand of an elasticized hairband material having an elastic rubber band covered with fabric that is integrated into the novel knitted articles of the invention. In either case the hairband is a rubber band or elastomeric material that is covered with fabric that is integrated by a plurality of loops into the knitted article either at or near the distal end of the knitted article or in a seam utilized to join the ends of the knitted article to form an article of headwear.

The precise manner of incorporating the hairband into the knitted article depends upon the method utilized for manufacturing the novel knitted article of the invention. In one manufacturing process for creating knitted articles a Bulkie Machine is utilized for knitting circular articles such as ski caps. In such machines capable of knitting circular articles the hairband is preferably knitted into the distal end of the knitted article by interconnecting the loops at the end of the knitted article and fastening the hairband to join all the loops to integrate the hairband into the knitted article and form a constrictive opening for the hair or ponytail of the wearer. In other processes for forming the novel knitted articles of the invention the knitted article of headwear can be knitted on a flatbed machine to provide a flat and preferably tapering knitted article in which the ends are knitted or joined together in the form of a seam running from the headband portion of the knitted article to the distal end of the knitted article into which seam a hairband is integrated with a plurality of loops intermediate the proximal and distal end of the novel article of headwear.

The novel knitted articles of the invention with the integrated hairband provide a cooperative interrelationship between the hairband and the headband of the headwear which combines the holding aspects of the hairband with the positioning of the headband to allow unrestricted movement of the wearer while maintaining the article of headwear in a predetermined desired position with respect to the hair and scalp of the wearer. The novel article of headwear allows a portion of the hair to extend through the constrictive opening provided by the hairband which maintains the headwear in a predetermined desired position irrespective of the motions or actions of the wearer such as may be engaged on the ski slope. Further the novel article of headwear prevents the hair from being crushed, disheveled or disorganized under the cap and allows a significant portion of the hair to be held in position outside of the novel article of headwear while maintaining the article of headwear in the predetermined desired position during exercise movement as may be encountered in jogging, skiing or other outdoor activities.

The cooperative advantages of the headband and the hairband of novel knitted articles of the invention are best achieved when the hairband and headband are in a substantially coplanar or co-axial configuration. In this configuration the hairband and headband are in direct alignment and provide the best cooperation between the headband and hairband in holding the article of headwear in place on the wearer's head. These novel articles of headwear are maintained in place in active sports such as skiing and jogging to anchor the article of headwear in place. Where the maximum holding efficiency of holding the hat in place is not desired such as for fashion the integrated hairband may be angularly offset to the headband intermediate the proximal and distal ends of the novel knitted article with the integrated hairband.

BRIEF DESCRIPTION OF THE DRAWINGS

The features and advantages of the invention will become more apparent in the Detailed Description of the Invention in conjunction with the accompanying Figures in which:

FIG. 3 is an enlarged perspective view of the integrated hairband in the novel headwear of the invention;

FIG. 4 is a cross-section of FIG. 3 taken along the line 4—4;

FIG. 5 is an enlarged perspective view of an integrated hairband with a metal crimp fastener engaged by a plurality of loops for integration into novel headwear of the invention;

FIG. 9 is a top plan view of the novel headwear with an integrated hairband knitted into the novel article of headwear;

FIG. 10 is a perspective view of a further embodiment of the novel headwear with an elastic hairband threaded through a plurality of loops in the knit to integrate the hairband into a novel article of headwear; and FIG. 11 is an exploded view of an alternative method for integrating an elastic hairband into a novel article of headwear.

DETAILED DESCRIPTION OF THE INVENTION

Figure 1:
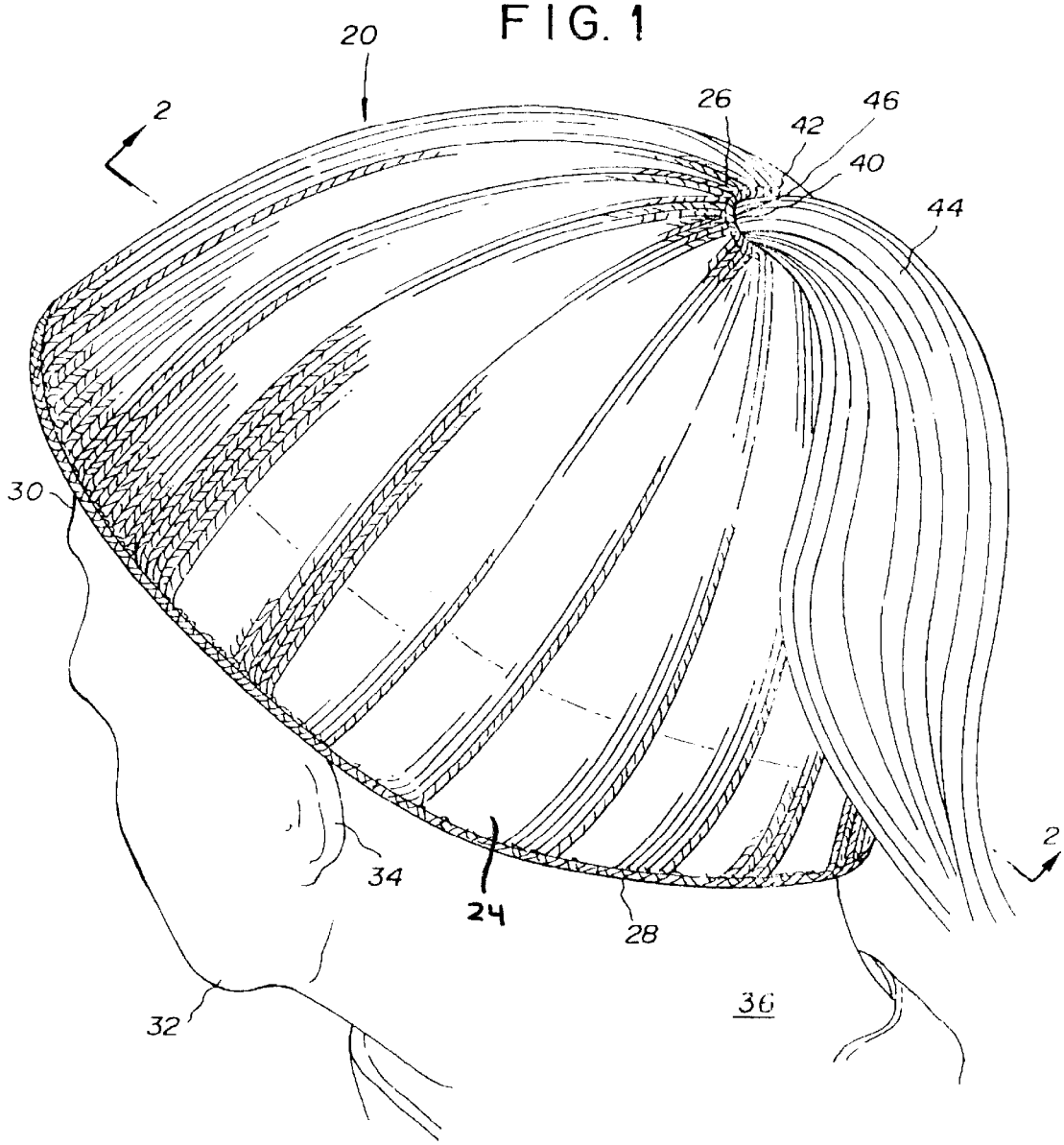
FIG. 1 is a perspective view of the novel headwear of the invention.

Typically the distinction between a knitted article and a woven article has been that knitted articles include a plurality of loops formed by hand or on a machine which are interlooped to form a knitted article. Generally knitted articles are formed from a single length of yarn or thread or multiple colors or types of yarn that are tied together to form the end knitted article having different colors, densities and stretch characteristics.

Woven articles on the other hand are generally formed with a set of warp and a set of weft threads which are interspersed to form the end article. Woven articles are generally dyed for color whereas knit articles typically achieve their color through the use of lengths of yarn of different colors.

The invention is applicable to either woven or knit articles where the woven or knit article includes a hairband which serves as a terminus for looped, yarn or thread in an article of headwear. The novel headwear as contemplated by the invention may be a typical skier's hat which will be described with respect to the best mode and preferred embodiment of the invention or other types of headwear articles such as hoods, parkas, caps, hats and the like having an integrated hairband which is integrated by looping the yarn or thread around the hairband to form novel articles of headwear constructed in accordance with the invention.

Referring now to FIGS. 1, 2, 2A and 3 a novel article of headwear 20 in the form of a skier's hat is illustrated in accordance with the best mode of the invention. The article of headwear 20 can be constructed by hand or by knitting machines capable of forming flat or circular articles and preferably tapered circular articles having a proximal end 24 and a distal end 26. Preferably proximal end 24 includes an elasticized or ribbed headband portion 28 for tightly fitting over the forehead 30 of wearer 32. Article of headwear 20 is generally worn to cover a portion of forehead 30 along with ears 34 and a portion of the back of the neck 36 which the wearer 32 generally desires to maintain in a fixed or substantially stationary position. Unfortunately the volume of hair 38 (FIG. 2) inside ordinary articles of headwear in conjunction with the amount of activity of wearer causes the elasticized or ribbed headband portion 28 of the article of headwear 20 to ride up on the hair of the wearer 32. The amount of movement of the prior art headwear on the head is dependent upon the amount of activity and volume of hair under the hat.

In accordance with the invention an integrated hairband 40 is integrated into a plurality of the loops 42 of yarn or thread forming the novel article of headwear 20. The plurality of loops 42 serve to capture integrated hairband 40 preferably into the distal end 26 of the novel headwear article to which a portion of the hair 44 is drawn through which is worn outside of the novel article of headwear 20. The combination of the portion of hair 44 outside the novel article of headwear engaged by integrated hairband 40 serves not only to close the novel article of headwear but also cooperates with elasticized or ribbed end portion 28 to anchor the novel article of headwear in a substantially fixed position on wearer's head 32 so that the novel article of headwear does not ride up over the wearer's forehead and ears. The angular relationship between elasticized or ribbed portion or headband portion 28 and integrated hairband 40 which in the best mode is substantially coplanar maintains the novel article of headwear in a substantially fixed position irrespective of the amount of movement or exercise of wearer 32 and the volume of hair of the wearer to prevent the novel article of headwear from riding up over the wearer's head.

Figure 2:
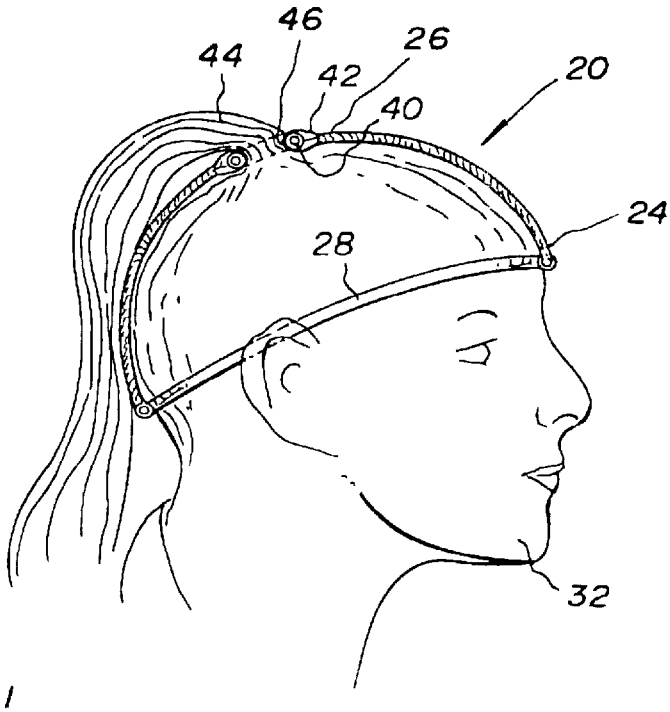
FIG. 2 is a cross-section of FIG. 1.
Figure 2A:
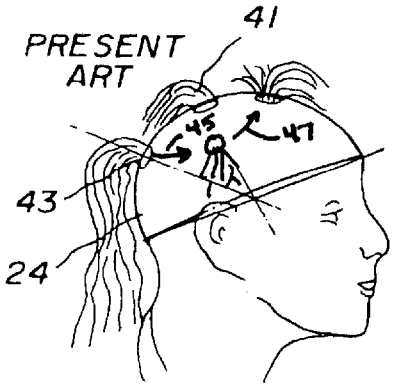
FIG. 2A is a diagrammatic illustration of the cooperation between the hairband and headband in novel headwear constructed in accordance with the invention.

In the best mode of the invention hairband 40 is integrated at or near distal end 26 of the novel article of headwear 20 to provide a maximum coaxial or coplanar relationship between the elasticized or ribbed end or headband portion 28 and the integrated hairband 40 as illustrated by hair position 41 in FIG. 2A. This substantially coaxial or coplanar relationship prevents the novel article of headwear 20 from riding up over the forehead, ears and neck of the wearer 32 and provides the maximum benefit for ski caps and other articles in which the wearer can exert the maximum exercise activity without movement of the novel article of headwear.

Movement of the integrated hairband 40 from a position from the distal end toward the proximal end such as position 43 in FIG. 2A lessens the effectiveness of the cooperative relationship between the integrated hairband 28 and elasticized or ribbed headband position 28. As a result as movement of wearer 32 and as the movement of the integrated hairband 40 proceeds toward the proximal end the effectiveness of the angular relationship is reduced by the effects of gravity upon the hair and in the volume of hair inside the novel article of headwear to result in greater possibility of the movement of the novel article of headwear 20 up over the forehead of the wearer 32. As a result where demands of fashion are more important than the integrity of the position of the hat for exercise the integrated hairband 40 may be moved from the distal end 26 toward the proximal end 24 within the scope of the present invention. However such non-coaxial or coplanar alignment of integrated hairband 40 with elasticized or ribbed headband portion 28 reduces the effectiveness of the relationship between the elasticized or ribbed headband portion 28 and the integrated hairband 40. For fashion the hole in position 43 may be moved by rotating the position of headwear 20 in the position of arrow 45 and 47 to allow the hair to be held at the side or toward the front of headwear 20 as illustrated in FIG. 2A.

Figure 2B:
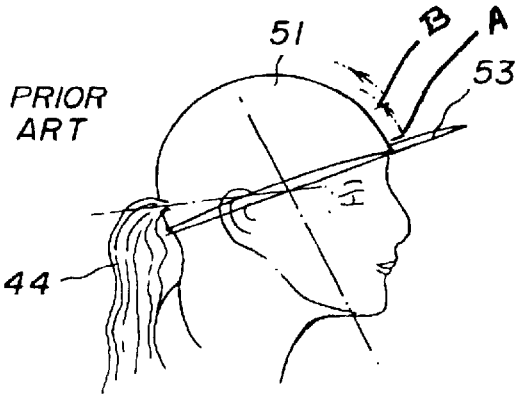
FIG. 2B is a prior art diagrammatic illustration similar to FIG. 2A of the forces operating on prior art fabric caps.

The invention pertains primarily to knitted articles and to the relationship between an elasticized or ribbed headband portion 28 and an integrated hairband 40 to maintain a novel article of headwear in a substantially fixed position. The prior art as illustrated in FIG. 2B pertains to woven baseball caps 51 which have a visor 53. These woven articles of the prior art, as opposed to knitted articles, have hair 44 disposed through the cap 51 without a hairband which by the action of gravity or exercise cause the cap 51 to rise up from position A to position B is compensated for by pulling down on visor 53. The invention by contrast pertains to knitted or woven articles having a hairband in which the effectiveness of the article in maintaining the novel article of headwear is achieved by maintaining a coplanar relationship or angular relationship up to about 40 degrees to maintain the novel articles of headwear substantially in place.

As illustrated in FIG. 2 the substantially coplanar relationship in the best mode between elasticized or ribbed headband portion 28 and integrated hairband 40 maintains the novel article of headwear 20 in a substantially fixed position on the wearer's 32 head. In addition the volume of hair 38 inside the novel article of headwear is channeled through the aperture 46 in a substantially perpendicular relationship to the headband forming the elasticized or ribbed portion 28. The portion of hair 44 outside the novel article of headwear 20 is straight through the top of the article of headwear and allows the hair of the wearer to be maintained in a substantially straight condition to avoid matting, tangling or other deleterious effects upon hairstyles of the wearer.

The integrated hairband 40 in the best mode serves as a terminus for the plurality loops 42 of the novel knitted article of headwear 20 which are interlooped with previous row of loops of knit 41 of the knitted article. These loops may be formed in knitted or woven articles so that the integrated hairband 40 is integrated into the knit 41 of the article. In the best mode the loops 42 at the distal end 26 are formed in the knitting process so that knitting begins at the proximal end and continues to the distal end with a reduced or tapering knit from the proximal end to the distal end. The integrated hairband 40 is then drawn through the remaining loops 42 of the article of headwear 20 and tied with a knot 48 (FIG. 3) to join the ends of the integrated hairband 40 to interconnect all the terminal loops of the knitted article. As will be described hereinafter in greater detail other methods are available for integrating the hairband into the novel knitted articles of the invention.

Hairbands may be obtained from a variety of sources such as K-Mart, Walmart, Ames and various drugstores selling ponytail hairbands which are then cut, threaded through loops 42 and then tied in knot 48 to join all the remaining loops 42 of the novel article of headwear 20. As is illustrated in FIG. 4 the integrated hairband includes a center elastic portion 50 which is typically covered with a fabric 52 and used to gather up ponytails. The elastic portion 50 may be of a circular cross-section as shown in FIG. 4 or a rectangular cross-section or other cross-section (not shown) as is commonly available for elasticized hairbands. The hairband may also be constructed from lengths of fabric covered rubber bands as are used to create hairbands or elasticized material such as long rubber strands and preferably fabric covered rubber or elastic band such as is used in Christmas wrapping and the manufacture of such hairbands as is carried by K-Mart as well as most drug stores.

The ends of the hairband may be joined by tying the ends into a knot 48 or the ends may be crimped together by a crimped section of metal 54 as is customarily utilized by forming ponytail hairbands. Further the elasticized ponytail hairband may be constructed of any elastomeric material forming a center core of the elastic portion 50 covered with a fabric cover 52 which is then threaded through or integrated into the plurality loops of the novel article of headwear 20 as will be described hereinafter in greater detail with respect to alternative embodiments of the invention.

Figure 6:
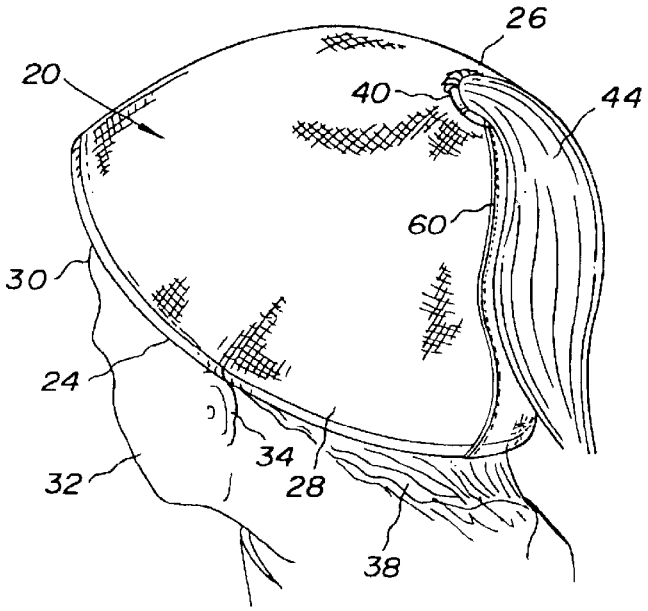
FIG. 6 is a perspective view of an alternative embodiment of the novel headwear of the invention.
Figure 7:
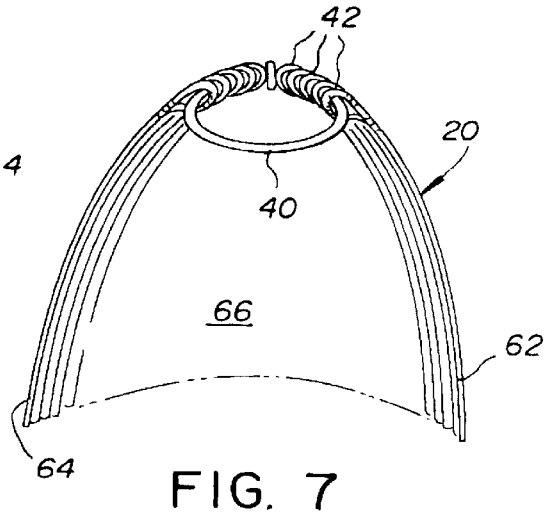
FIG. 7 is a side elevational view of a stage of the construction of the novel headwear of FIG. 6 on a flat knitting machine.

Referring now to FIGS. 6 and 7 an alternative embodiment of the novel article headwear 20 is illustrated having a seam 60 formed by joining ends 62 and 64 to form the novel article of headwear 20. The article of headwear 20 as illustrated in FIGS. 6 and 7 may be formed by hand or on a standard flatbed knitting machine which knits a flat article having ends 62 and 64 which are subsequently joined in a seam to capture integrated hairband 40 in a plurality of loops 42 to form novel article of headwear 20. The seam 60 is formed during the hand-knitting or automated machine knitted article 66 in FIG. 7 in which the end loops 42 are joined together with by integrated hairband 40 in which the ends of hairband 40 which are tied with a knot 48 as heretofore discussed with FIG. 3 or crimped as heretofore discussed with respect to FIG. 5. The integrated hairband 40 assists in forming the novel tapered knitted article of headwear in which ends 62 and 64 are joined together by seam 60. The novel article of headwear as illustrated in FIGS. 6 and 7 may be ribbed or without ribs but includes an elasticized headband portion 28 at the proximal end 24. In all other respects the novel article of headwear 20 as illustrated in FIGS. 6 and 7 is similar to the novel article of headwear 20 of FIGS. 1 and 2 with the exception of seam 60 as heretofore described.

Figure 8:
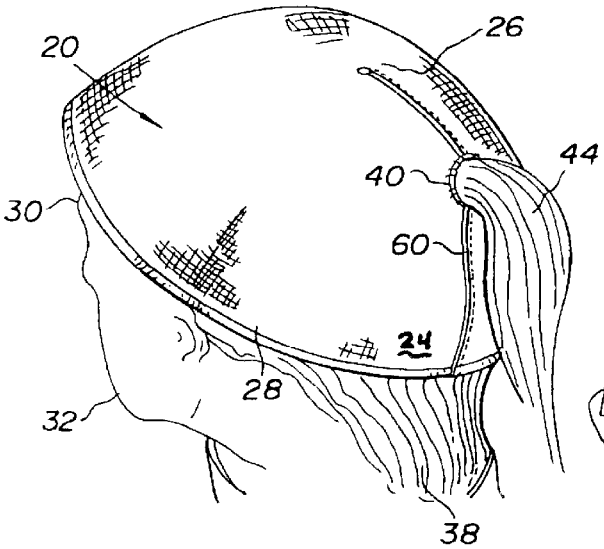
FIG. 8 is a perspective view of a further embodiment of the novel headwear with the hairband disposed intermediate the ends of a novel knitted article of headwear.

Referring now to FIG. 8 an alternative embodiment of the novel article of headwear 20 is illustrated having a seam 60 running from proximal end 24 to distal end 26. Positioned in seam 60 intermediate proximal end 24 and distal end 26 is the novel integrated hairband 40. The embodiment of the novel article of headwear 20 as illustrated in FIG. 8 does not include a substantially coplanar relationship between elasticized or ribbed headband portion 28 and integrated hairband 40. As heretofore discussed as hairband 40 is moved from the distal end toward the proximal end the effectiveness of the relationship between elasticized or ribbed headband portion 28 and integrated hairband to anchor headwear 20 to the wearer's head is reduced. However, in some applications where fashion rather than vigorous exercise is contemplated then the coplanar relationship between elasticized or ribbed headband portion 28 and integrated hairband 40 can be eliminated in favor of an angular relationship between the hairband 40 and the headband portion 28 and the hairband 40 can be integrated into the seam 60 between proximal end 24 and distal end 26. In this embodiment of the invention the hair 38 inside the novel article 20 is drawn to and around the back side of the head and drawn through integrated hairband 40 to provide a snug fit for the ponytail of the wearer. In this embodiment the advantages of the invention in not matting, tangling or otherwise interfering with the hairdo of the wearer is achieved in accordance with the invention.

Referring now to FIG. 9 an alternative embodiment of the invention is illustrated wherein the integrated hairband 40 is knitted into the novel article of headwear 20. The integrated hairband 40 in this case is a strand of elastic material covered with a fabric similar to as heretofore described with respect to FIG. 4 or 5 except that the plurality of loops 42 engaging hairband 40 are the starting loops of the knitted article since in this case the article is knitted from the distal end to the proximal end. One end 68 is knotted into the knit with a knot 70 and is then knitted into the article of headwear utilizing the integrated hairband as a portion of the knitted article. The other end 72 is then joined or crimped by a metal band 74 to form the integrated hairband 40 in the novel article of headwear 20.

Various other forms of integrated hairband 40 and joining the ends of the integrated hairband into the novel article of headwear 20 may be achieved one of which is illustrated in a further embodiment illustrated in FIG. 10. In FIG. 10 the novel article of headwear 20 is knitted by hand or machine in either a flat or circular three-dimensional configuration leaving a hole 80 in the novel article of headwear 20. The hole 80 is constricted with an integrated hairband 40 by threading a length of integrated hairband material through the loops of the knitted material adjacent to the hole 80 to form a novel article of headwear 20 in accordance with the invention. The loops 82 of yarn surrounding hole 80 serve to integrate the integrated hairband into the novel article of headwear and the ends of the integrated hairband are then adjoined together to form the novel article of headwear of the invention.

Referring now to FIG. 11 a further method of integrating a hairband into the novel knitted article of headwear is illustrated. The novel article of headwear 20 is knitted or formed from fabric leaving a hole 80 in the article of headwear 20. A hairband 40 is integrated into the article of headwear by utilizing a plurality of loops 42 which are created by sewing, crocheting or otherwise forming loops 42 around integrated hairband 40 to integrate integrated hairband into the novel article of headwear 20.

The method of the invention for constructing novel articles of headwear include creating a fabric article having a hole therein utilizing a hairband to constrict said hole and creating a plurality of loops to integrate said hairband into said hole. The method of the invention can be practiced on fabric weaving machines, knitting machines of various designs and construction including both flat and circular knitting machines or by hand. The integrated hairband 40 may be integrated by first creating the article with the hole and then integrating the hairband into the plurality of terminal loops of the knitted article or by closing the plurality of terminal loops with a standard knitting closure and then integrating the hairband by threading a hairband through a plurality of loops forming the knitted article to integrate the integrated hairband into the novel article of headwear or by knitting a length of fabric covered elasticized hairband material into the article of headwear and then limiting the amount of elasticity of the knitted hairband material by a metal brad or staple as heretofore described with respect to FIGS. 9 and 10.

The method of the invention also includes the forming of fabric articles having a plurality of loops and then connecting the plurality of loops to integrate the elastic hairband into the fabric article and then joining the ends of the hairband to form the novel fabric article of headwear. As heretofore discussed the novel article of headwear includes a plurality of loops for integrating the hairband into the novel article of headwear and may include a threading of the headband through the plurality of terminal loops or threading a length of hairband material through knitted or woven loops in the article to constrict the hole in the article and then closing the hairband by knotting, adding a metal brad or other means for limiting the elasticity of the elasticized hairband so that it functions to tightly engage the hair of the wearer so that a portion of the hair remains outside the novel article of headwear.

Typically the diameter of the constricted hole created by the integrated hairband 40 is about the size of standard ponytail hairbands or slightly less. Typically this diameter is from about 0.5 to 2 inches and the thickness of the hairband is typically 0.05 to 0.3 of an inch in diameter which includes the fabric covering. In all such cases the integrated hairband serves to constrict the hole in the article or serves to constrict the hole in the article and join the terminal ends of the loops of the knitted article.

As will be recognized by those skilled in the art the invention is susceptible to a wide range of modifications and embodiments to form novel headwear articles containing an integrated hairband for maintaining a relationship between an elasticized portion in the proximal end of the article of headwear with the integrated hairband disposed in the novel article of headwear intermediate the distal end and proximal end of the novel article of headwear. The novel article of headwear further may be formed in a variety of ways utilizing flat knitting machines for preparing substantially planar knitted articles or circular knitting machines for providing circular knitted articles in which an integrated hairband is provided to anchor the novel article of headwear to the head of the wearer while preserving the integrity of the hairdo of the wearer.

Further a wide degree of modification is provided for integrating the hairband into novel headwear in accordance with the invention. The ends of the hairband may be crimped, tied or otherwise fastened or integrated into the knitted article to provide a hairband for receiving and maintaining the position of the hair in the hairband and maintain the novel article of headwear on the head of the wearer in a substantially fixed position.

The invention may be implemented in a number of ways and it is to be understood that these and other changes and modifications may be made by those skilled in the art which are within the scope of the appended claims.

As used herein and in the following claims, the word 'comprising' or 'comprises' is used in its technical sense to mean the enumerated elements include but do not exclude additional elements which may or may not be specifically included in the dependent claims. It will be understood such additions, whether or not included in the dependent claims, are modifications that both can be made within the scope of the invention. It will be appreciated by those skilled in the art that a wide range of changes and modification can be made to the invention without departing from the spirit and scope of the invention as defined in the following claims:

What is claimed is:

1. An article of headwear comprising:

(a) a proximal portion having an elastic portion for engaging the head;

(b) a distal portion having a distal end disposed at distanced position from said proximal portion;

(c) an elastic hairband having a metal brad connecting the ends of said elastic hairband said elastic hairband disposed intermediate said proximal portion and said distal portion; and (d) a plurality of loops in said distal end of the article of headwear, said plurality of loops interconnected and maintained in substantial coplanar alignment by said elastic hairband in the article of headwear.

2. The article of headwear of claim 1 wherein said elastic hairband is disposed in said distal end.

3. The article of headwear of claim 2 wherein said distal end is substantially coplanar with said proximal portion.

4. The article of headwear of claim 3 wherein said elastic hairband is knitted into the article of headwear by interconnecting a plurality of terminal loops.

5. The article of headwear of claim 4 wherein said metal brad limits the degree of elasticity of said elastic hairband.

6. A knitted article of headwear comprising:

(a) an article having a first end and a second end;

(b) an elastic headband disposed in said first end for engaging the head;

(c) an elastic hairband disposed intermediate said first end and said second end; and (d) a plurality of loops disposed in said article said plurality of loops interconnected and maintained in substantial coplanar alignment by said elastic hairband disposed through and substantially perpendicular to the axis of said plurality of loops for securing said elastic hairband to said article.

7. The knitted article of headwear of claim 6 wherein said elastic hairband is disposed in said second end.

8. The knitted article of headwear of claim 6 wherein said first end and said second end are substantially coplanar.

9. The knitted article of headwear of claim 8 wherein said elastic hairband is a fabric covered elastic material.

10. The knitted article of claim 9 wherein said elastic hairband interconnects the terminal loops of said article.

11. The knitted article of claim 9 wherein said elastic hairband includes a metal brad for interconnecting the ends of said elastic hairband.

12. The knitted article of claim 9 wherein said elastic hairband is threaded through said plurality of loops.

13. The knitted article of claim 9 wherein said elastic hairband is knitted into said plurality of loops by interconnecting a plurality of terminal loops.

14. The knitted article of claim 6 wherein said elastic hairband is disposed in a seam intermediate said first end and said second end.

15. The knitted article of claim 6 wherein said elastic hairband is at said second end and connects a portion of a seam disposed intermediate said first end and said second end.

16. A method for producing an article of headwear comprising:

(a) forming a fabric article having an elasticized hole therein and a plurality of open loops;

(b) interconnecting said plurality of open loops with an elastic headband to close said open loops with said elastic headband and integrate said elastic headband into said fabric article; and (c) joining the ends of said elastic hairband to maintain said plurality of loops in a substantially coplanar relationship and form a fabric article of headwear having said elasticized hole therein.

17. The method of claim 16 wherein said article is formed on a knitting machine for making circular articles.

18. The method of claim 16 wherein said article is formed on a knitting machine for making flat articles.

19. The method of claim 18 further comprising the step of forming a seam between said elastic hairband and the ends of said article.

* * * * *